US008540197B1

(12) United States Patent
Krol, II et al.

(10) Patent No.: US 8,540,197 B1
(45) Date of Patent: Sep. 24, 2013

(54) SKATEBOARD MOUNTING ARRANGEMENT

(76) Inventors: Frederick S. Krol, II, Wethersfield, CT (US); Kevin A. Polak, Southington, CT (US)

( * ) Notice: Subject to any disclaimer, the term of this patent is extended or adjusted under 35 U.S.C. 154(b) by 370 days.

(21) Appl. No.: 12/800,714

(22) Filed: May 21, 2010

(51) Int. Cl.
*A47G 1/17* (2006.01)

(52) U.S. Cl.
USPC ..... 248/206.5; 248/683; 248/309.4; 211/DIG. 1

(58) Field of Classification Search
USPC ..... 248/309.4, 206.5, 309.1, 683, 205.1; 206/315.1, 818; 211/87.1, 85.7, 94.01, DIG. 1; 280/843, 11.19, 11.223, 611, 612; 40/10 R, 40/600; 269/8
See application file for complete search history.

(56) References Cited

U.S. PATENT DOCUMENTS

| | | | | |
|---|---|---|---|---|
| 4,878,585 | A * | 11/1989 | Orestano | 211/87.01 |
| 5,014,955 | A * | 5/1991 | Thompson | 248/309.1 |
| 5,582,044 | A * | 12/1996 | Bolich | 70/58 |
| 6,216,888 | B1 * | 4/2001 | Chien | 211/87.01 |
| 6,832,711 | B2 * | 12/2004 | Black | 224/628 |
| 6,942,094 | B2 * | 9/2005 | Coulson | 206/315.1 |
| 7,891,616 | B2 * | 2/2011 | Pinchuk et al. | 248/206.5 |
| 7,950,535 | B1 * | 5/2011 | Schmid | 211/85.7 |
| 8,042,308 | B2 * | 10/2011 | Sullivan et al. | 52/238.1 |
| D650,460 | S * | 12/2011 | Krol, II | D21/771 |
| 2005/0029767 | A1 * | 2/2005 | Chang | 280/87.042 |

* cited by examiner

*Primary Examiner* — Todd M. Epps

(57) ABSTRACT

A skateboard mounting arrangement consists of a top part that includes a magnet and a bottom part that includes a bottom extension. When the bottom part is mounted below the top part on a wall support, the bottom of the skateboard is retained by the bottom extension and the magnet attracts and holds the top part to the wall support.

3 Claims, 4 Drawing Sheets

SKATEBOARD MOUNTING ARRANGEMENT

BACKGROUND OF THE INVENTION

Various methods for temporary mounting of sports boards, such as snowboards, surfboards and skateboards, to walls are currently available.

One such snowboard mounting arrangement is described within U.S. patent application Ser. No. 29/348,995 entitled "Sports Board Mount".

When a colorful design is arranged on the bottom of the skateboard surface, it would be advantageous to mount the skateboard and completely display the accorded design.

The problem with most mounting arrangements is that the size of the mounting clamps tends to block part of the skateboard design.

Accordingly, one purpose of the instant invention is to provide a skateboard mounting arrangement with minimum optical inference with the skateboard design, per se.

SUMMARY OF THE INVENTION

A skateboard mounting arrangement consists of a top mounting part that is arranged on a support wall and a bottom mounting part arranged at a predetermined distance below the top mounting part on the support wall. The top part includes a magnet for attracting and holding the top part of the skateboard to the support wall and the bottom mounting part includes an extension for receiving the bottom edge of the skateboard thereon.

DESCRIPTION OF THE PREFERRED EMBODIMENT

Figure 1:
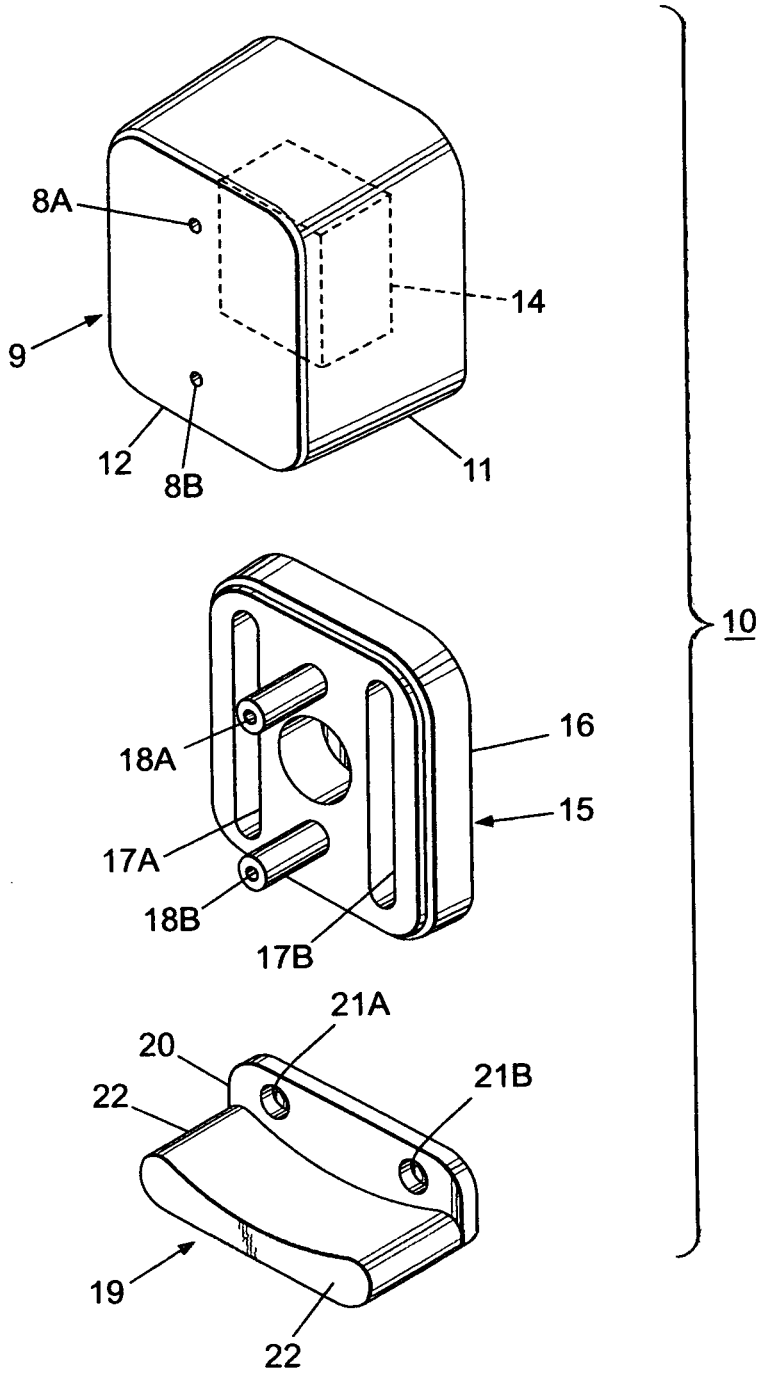
FIG. 1 is a front perspective view of the skateboard mounting components according to the invention.
Figure 2:
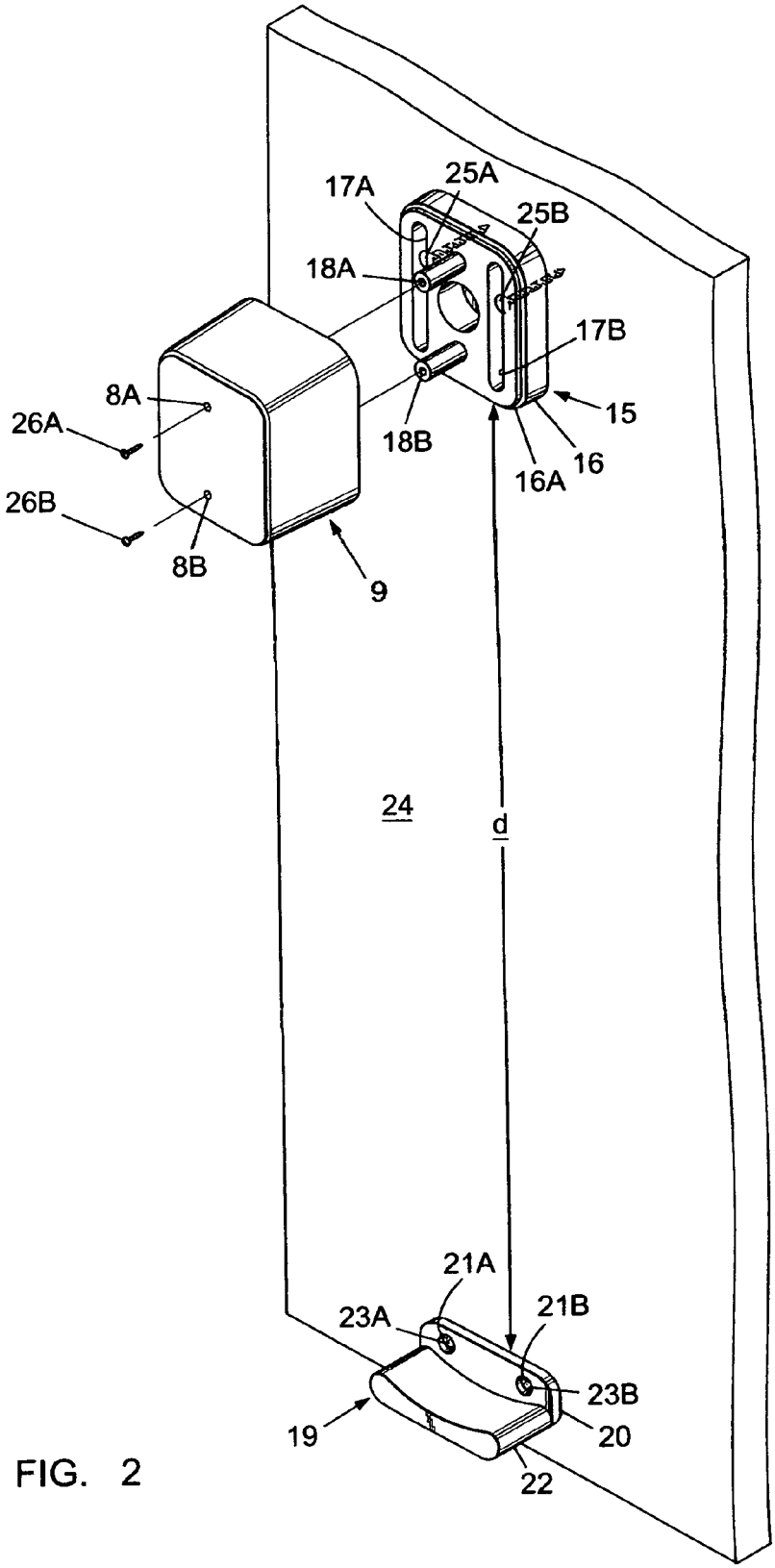
FIG. 2 is a front perspective view of the skateboard mounting components partially attached to a support wall.

The skateboard mounting arrangement 10 in accordance with the invention is shown in FIGS. 1 and 2 and consists of three basic components, the first of which is the magnet container 9 in the form of a rectangular container 11 into which the magnet 14 is inserted and a cover 12, is fastened to the container 9 via screws 26A, 26B and openings 8A, 8B.

The second component of the skateboard mounting arrangement 10 consists of a magnet container attachment plate 15 in the form of a thin rectangular plate 16 which includes a pair of elongated slots 17A, 17B for positioning the attachment plate 15 along the support wall 24 and fastening the attachment plate 15 to the support wall 24 via screws 25A, 25B before fastening the magnet container 9 to the attachment plate 15.

The third component of the skateboard mounting arrangement 10 comprises a bottom support 19, which defines a base 20 including openings 21A, 21B, for receiving a pair of screws 23A, 23B for attaching the bottom support 19 to the support wall 24. An upstanding extension 22 projects from the base 20 for purposes to be described below.

With the attachment plate 15 attached to the support wall 24, as shown in FIG. 2, via screws 25A, 25B and slots 17A, 18B within the plate 16, the magnet holder 9 is then attached to the plate 15 by positioning the holder 9 over the plate 15 as indicated, and inserting the screws 26A, 26B thru openings 8A, 8B in the magnet holder 9 into the openings 18A, 18B in the attachment plate 15 and tightening the screws 26A, 26B therein.

The bottom support 19 defining the base 20 including openings 21A, 21B, for receiving a pair of screws 23A, 23B to attach the support 19 to the support wall 24 at a predetermined distance d from the bottom end 16A of the plate 16 such that the upstanding extension 22 is situated away from and parallel with the bottom end 16A of the plate 16.

Figure 3:
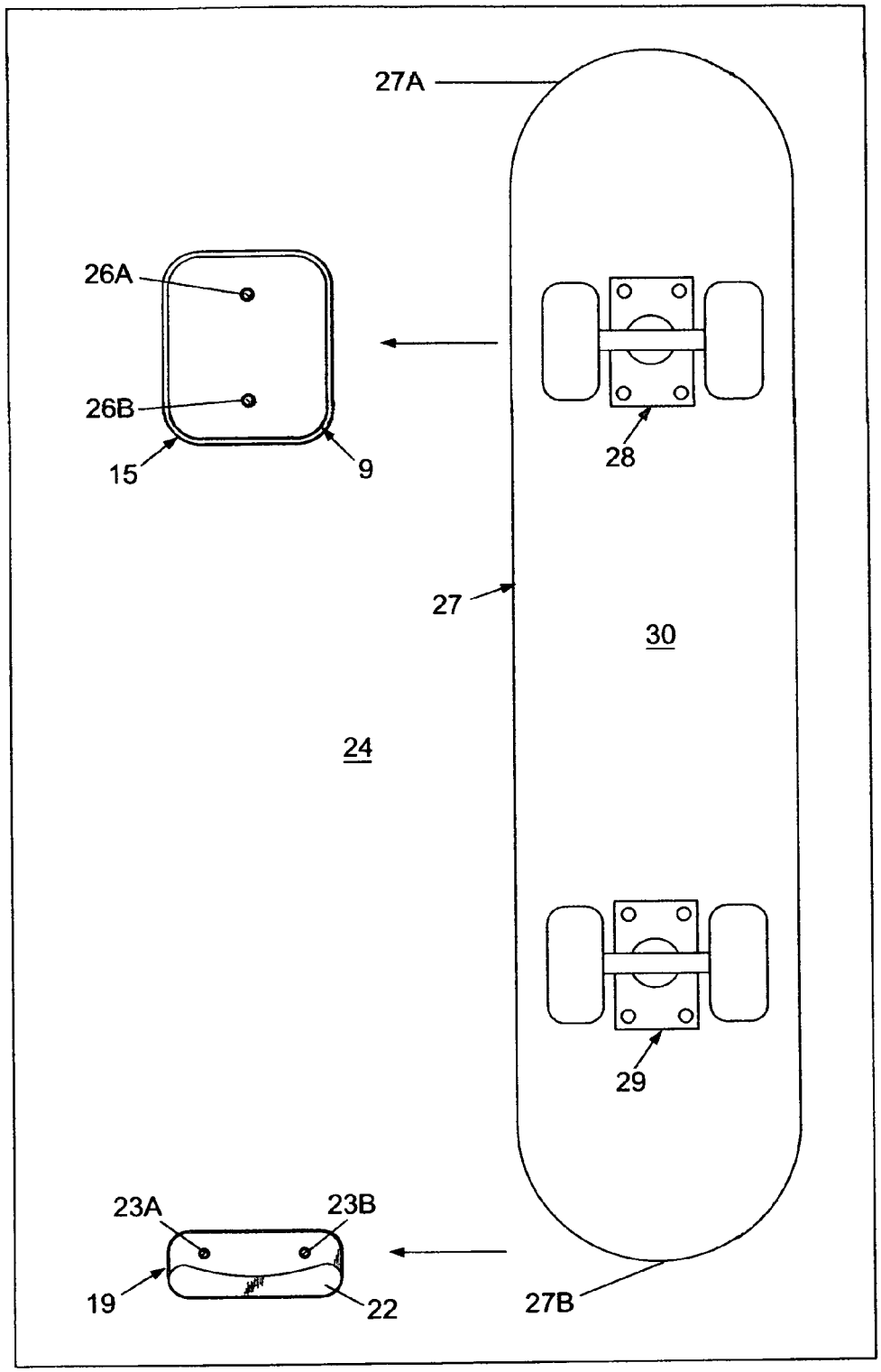
FIG. 3 is a front view of the skateboard mounting components assembled to the support wall prior to attaching the skateboard.

The magnet holder 9 is shown in FIG. 3 fastened to the attachment plate 15 via screws 26A, 26B on the support wall 24 and the bottom support 19 is shown attached to the support wall 24 via screws 23A, 23B with the upstanding extension 22 positioned as described earlier.

A skateboard 30 such as that manufactured by Element Skateboards of Irvine, Calif. and including an elongated board 27 having a front rounded end 27A and a rear rounded end 27B, also includes a front wheel assembly and a rear wheel assembly as indicated at 28, 29. Although not shown herein, the wheel assemblies 28, 29 include metal screws for attaching the wheel assemblies to the elongated board 27.

To support the skateboard 30 on the support wall 24, the end 27B of the elongated board 27 is moved in the indicated direction into abutment with the upstanding extension 22 on the bottom support 19 and the end 27A is moved in the indicated direction such that the backside (not shown) of the elongated board 27 opposite the front wheel assembly 28 abuts the magnet holder 9.

Figure 4:
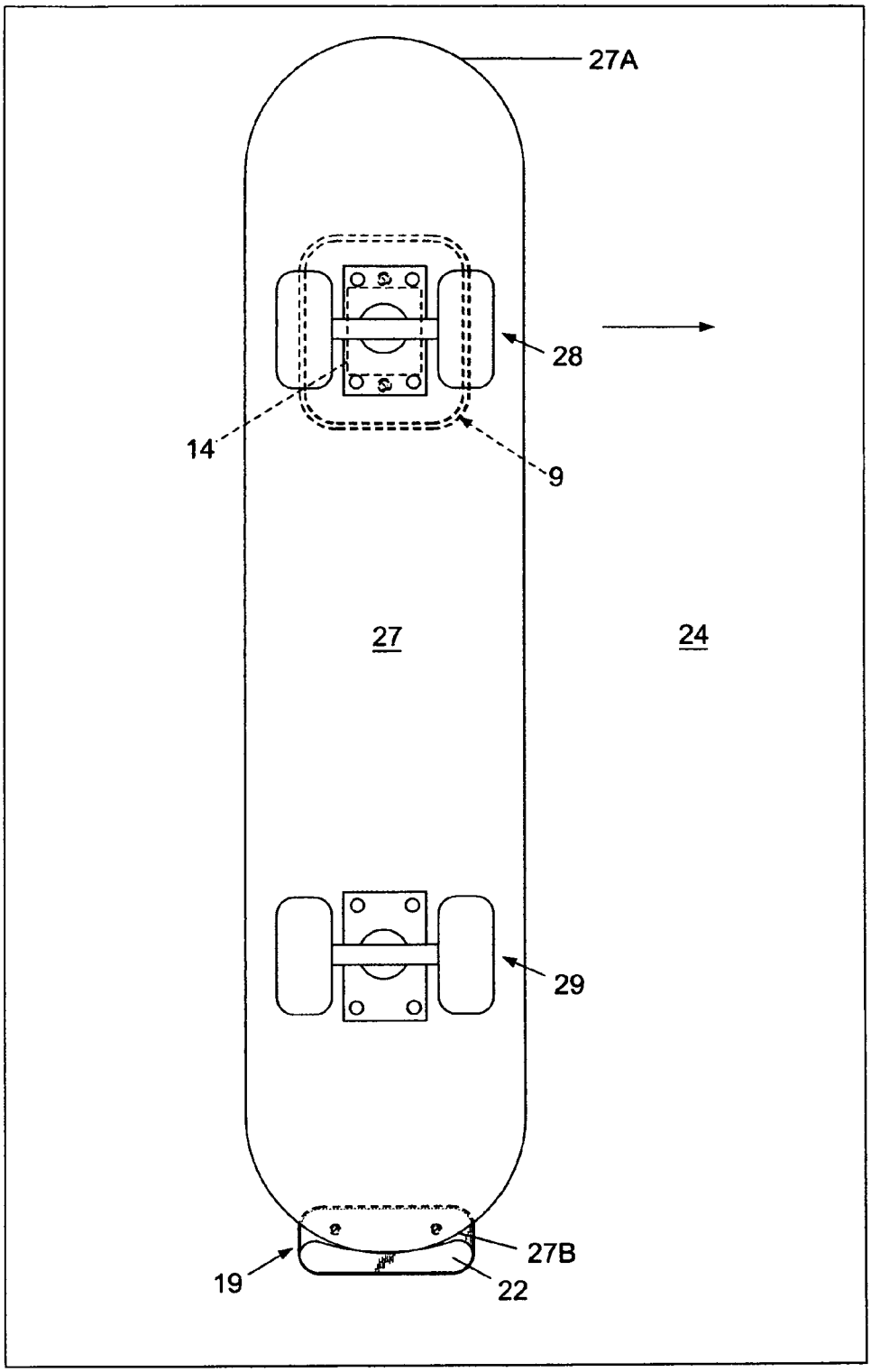
FIG. 4 is a front plan view of the skateboard mounted to the skateboard mounting arrangement according to the invention.

The skateboard 27 is shown supported on the support wall 24 in FIG. 4 with the front wheel assembly and a rear wheel assemblies 28, 29 extending outward from the support wall 24 and the magnet 14 within the magnet holder 9 subjacent the front wheel assembly 28.

As described earlier, the metal screws (not shown) contained within the front wheel assembly 28 is magnetically attracted and tightly held by the magnetic field (not shown) produced by the magnet 14.

To remove the skateboard 27 from the support wall 24, the top portion 27A of the skateboard is slidingly moved in the indicated direction away from the magnet holder 9 moving the front wheel assembly 28 away from the magnet 14 to enable lifting the skateboard end 27B away from the upstanding extension 22 on the bottom support 19.

A skateboard mounting assembly has been described herein that uses a magnet to attract and hold the metal screws within the skateboard, per se.

Although the mounting assembly of the invention is described relative to a skateboard, it is to be understood that the mounting assembly could be used to hold other sport boards that include metal components.

What is claimed is:

1. A skateboard mounting arrangement comprising:

a top part arranged for fastening to a support wall, said top part including a magnet therein; and a bottom part arranged for fastening to said support wall, said bottom part including means for retaining a bottom end of a skateboard;

said top part comprising a rectangular container having a closed end and an open end thereon and an attachment plate arranged proximate said open end for attaching said top part to said support wall, said magnet being arranged proximate said closed end for attraction between said magnet and a top end of said skateboard with metal screws.

2. The skateboard mounting arrangement of claim 1 wherein said bottom part comprises a base portion having an upstanding extension thereon for receiving a bottom end of said skateboard.

3. A method for attaching a skateboard to a support wall comprising the steps of: attaching a magnet container to a support wall;

attaching a bottom support to said support wall at a predetermined distance beneath said magnet container;

positioning a bottom end of said skateboard on said bottom support; and positioning a top end of said skateboard proximate said magnet container for attraction between said magnet container and said top end of said skateboard with metal screws.

* * * * *